US007281972B2

(12) United States Patent
Tocher

(10) Patent No.: US 7,281,972 B2
(45) Date of Patent: Oct. 16, 2007

(54) ULTIMATE VENT

(75) Inventor: John William Tocher, Chilliwack (CA)

(73) Assignee: John Tocher, Calgary, Alberta (CA)

( * ) Notice: Subject to any disclaimer, the term of this patent is extended or adjusted under 35 U.S.C. 154(b) by 659 days.

(21) Appl. No.: 09/981,060

(22) Filed: Oct. 18, 2001

(65) Prior Publication Data

US 2002/0123305 A1 Sep. 5, 2002

(51) Int. Cl.
*F24F 13/04* (2006.01)

(52) U.S. Cl. ..... 454/265; 454/275; 454/283

(58) Field of Classification Search ..... 454/267, 454/276, 277, 356, 4
See application file for complete search history.

(56) References Cited

U.S. PATENT DOCUMENTS 4,175,538 A * 11/1979 McCarty ..... 126/109
4,509,681 A * 4/1985 Kogut ..... 126/112
4,735,130 A * 4/1988 Seppamaki ..... 126/112
5,052,286 A * 10/1991 Tubbesing et al. ..... 454/365
5,257,736 A * 11/1993 Roy ..... 165/232

* cited by examiner

*Primary Examiner*—Derek S. Boles

(57) ABSTRACT

An inexpensive fresh air intake pre-filtering device for make-up air is disclosed for use with a circulating forced air heating system that is installed on an outside wall of a building. The device is comprised of a polyethylene material with an outer flange for securing the fresh air intake to the exterior wall surface. The fresh air intake housing is structured to include an aluminum frame, two sided raised pattern grill of a RX Poly-Med filter medium, manufactured from 100% synthetic fibers. This is to prevent vermin, insects, pollens, and other pollutants from passing through, while permitting the 10% of air flow required by the Nation and Regional Building Codes for residential housing. This washable filter is easily removed or installed by the pull-tab on the front of the vent housing. This Pre-filtering device is designed to prevent snow and rain from entering the fresh air intake duct.

3 Claims, 3 Drawing Sheets

SPECIFICATIONS

ULTIMATE VENT

BACKGROUND OF THE INVENTION

1. Field of the Invention

A supply of make-up and combustion air is required for buildings with forced air heating from furnaces with a combustion chamber that burns fuel of natural gas or oil. Buildings are airtight rely on the make-up air supply to maintain a neutral or positive pressure so products from combustion don't enter the inhabited areas. While the forced air fan is operating it will draw in through the fresh air intakes upward of 180 to 125 cfm or what calculates into 10% of the make-up required for the building's particular furnace circulating system.

Where screens are required on air intakes supplying make-up air, the building code requires that the screens with less than ¼ inch. It's gross area shall be three times greater than the duct it serves. They shall be removable without any special tools and made of a none corrosive resistant material.

2. Description of the Related Art

In art, a device has been introduced for supplying make-up air to the forced air furnace circulating system as shown by Kogut, Jimmy A. U.S. Pat. No. 4,509,681, is known to use the same standard screen openings, ¼ inch, which is not removable for cleaning on the fresh air intakes. Screens of this nature are known to plug up with debris, freeze up with frost and snow, imposing difficulty on the air intakes to supply the make-up air, there by creating a negative pressure and allowing products of combustion into the inhabited areas, possibly at unsafe levels.

Studies show these air intakes develop a build up over time by allowing insects, mice, pollens, dust mites, allergens, and air borne bacteria to enter the furnace's circulating system, this accumulation and confinement has raised some health concerns.

REFERENCES CITED 10-1991 Tusbbesing et al, CL.454/365 is a roof vent and is not designed for heating circulation systems.

04-1985 Kogut, CL.126/112 clearly states the screen 58 is a conventional industrial wire screen of the type having wire barbs at each of the screen intersections and a mesh similar to a window screen.

This wire screen is a standard ¼ in. screen used on all heating make-up air intakes for the past forty years.

SUMMARY OF THE INVENTION

The invention is directed to furnace forced air heating make-up air circulating system for a building, relating more to residential homes.

A pre-filtering device being mounted on an outside wall of a building and connected to the make-up air inlet conduit to the return air duct accomplishes a better quality make-up air.

Further, in accordance with this invention, while the furnace fan is operating the 10% of make-up air required is being drawn through the pre-filtering device stops most pollutants such as dust mites, pollens, allergens, and air borne bacteria as well as insects, before entering through the wall and into the return air duct.

Further, in accordance with this invention, an aluminum frame with a raised pattern grill allows the frost to build up and dissipate through the filter medium in the winter months.

Further, in accordance with this invention, there are no special tools required for installing, removing for service, or cleaning of the screen.

In the following detailed description and drawings that follow, a more complete understanding of the invention will be obtained.

DESCRIPTION OF THE SEVERAL VIEWS OF THE DRAWING (S)

Figure 1:
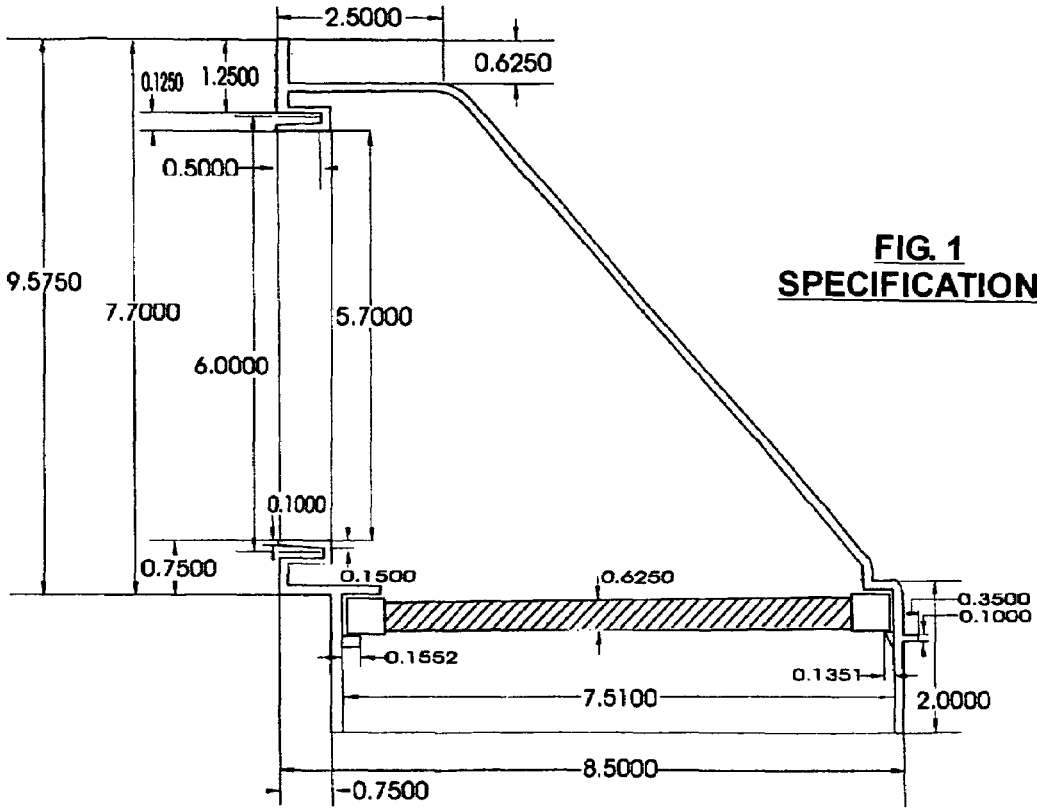
FIG. 1 Show a side evaluation view of the pre-filtering device with it's specifications.
Figure 2:
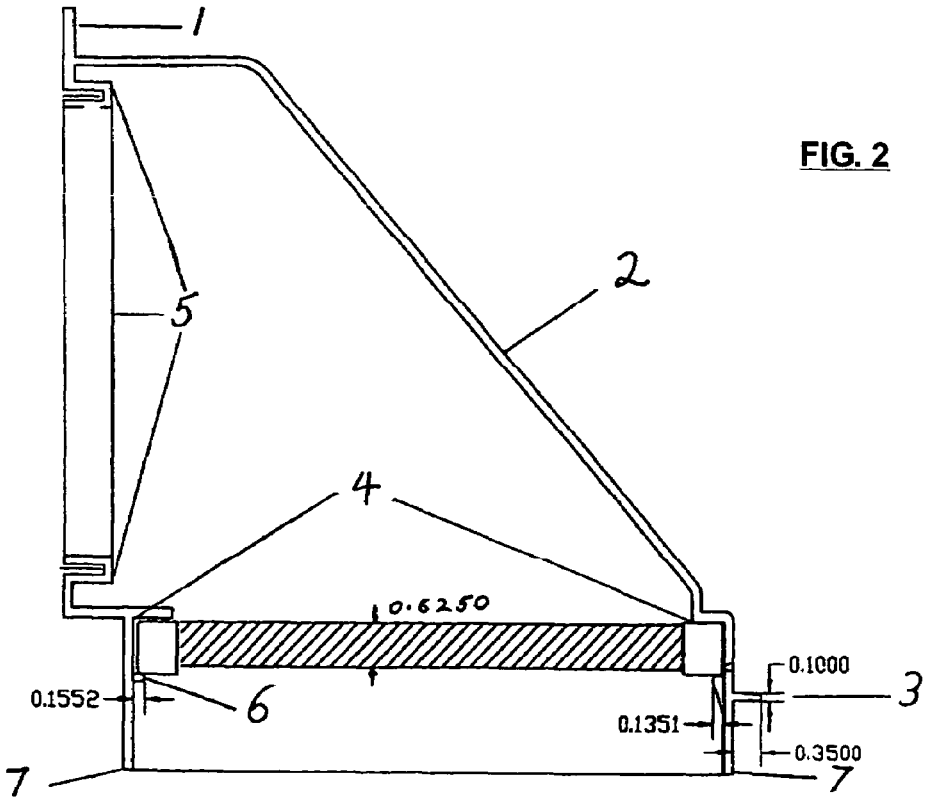
FIG. 2 Is a side evaluation view showing the embodiment of the invention.
Figure 3:
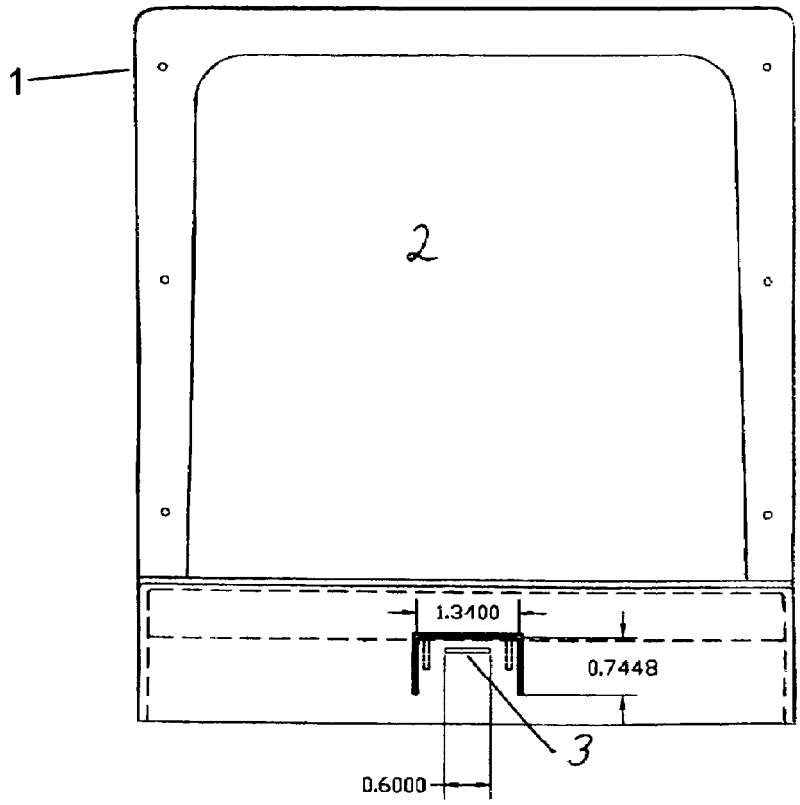

FIG. 3 This is a view showing a one piece housing and flange for mounting on an outside wall with the tab for releasing the filter.

Figure 4:
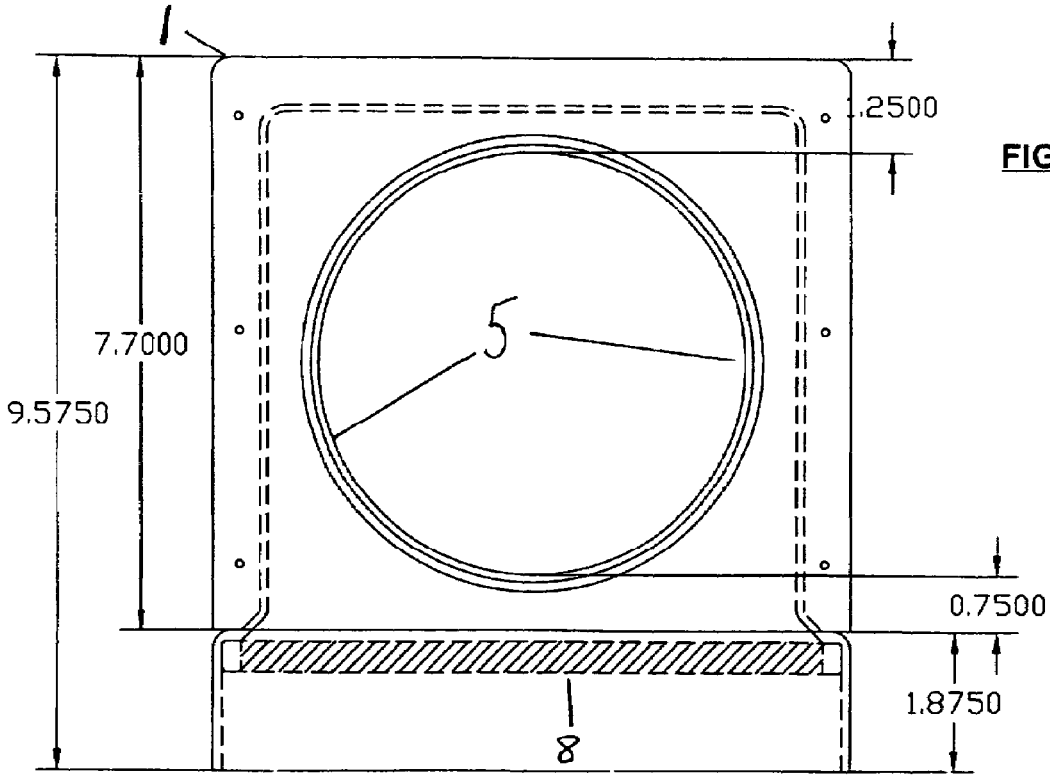

FIG. 4 Is showing a rear view that's placed against the wall for mounting as well as the groove in the inverted flange.

Figure 5:
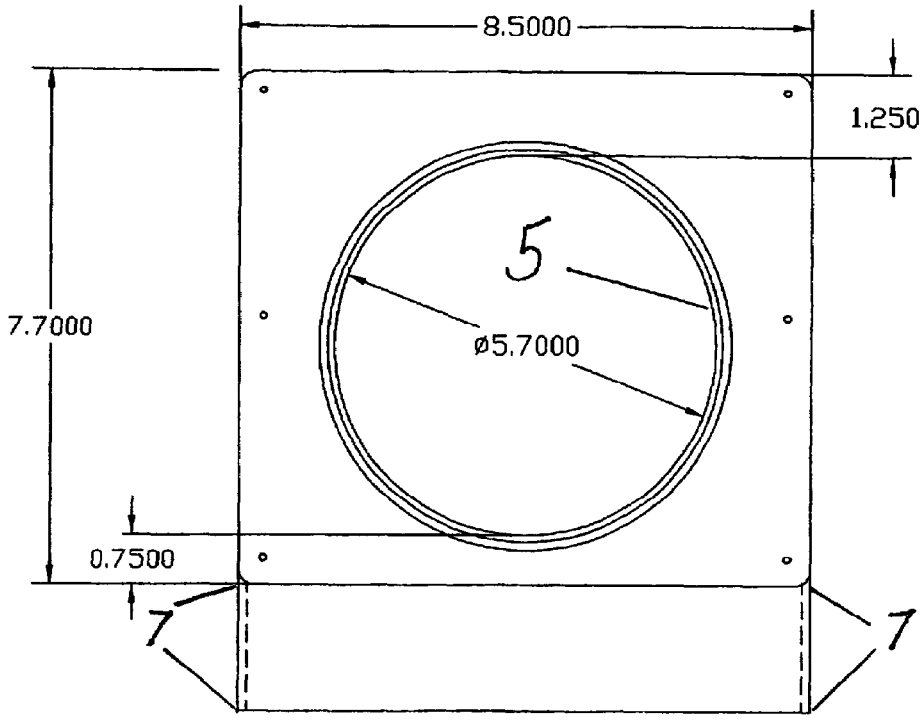

FIG. 5 This is the same as figure No. 4 showing the inverted flange and depth of the intake opening.

Figure 6:
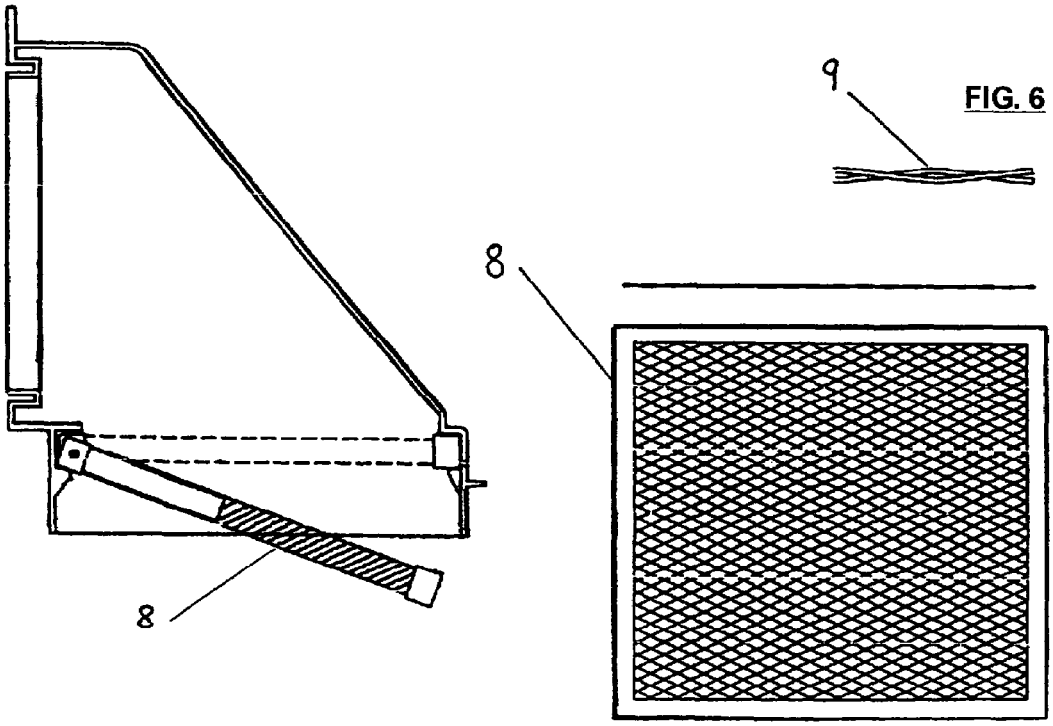

FIG. 6 Shows a side evaluation view of how the filter is installed and uninstalled with a view of the filter and screen with it's raised pattern grill.

Drawings previously submitted and accepted.

DETAILED DESCRIPTION OF INVENTION

As shown in the drawings, a fresh air intake pre-filtering device is made as a one piece, polyethylene injected molded vent adapted to be mounted on as outside wall of a building. The vent has a planar base (1) with an opening, and an integrally connected inverted flange around the opening. The inverted flange (5) is invert in such a manner that it creates a circumferential groove open towards the wall. A fresh air intake opening in the building wall is placed in the grieve allowing the vent to be flush mounted on the wall.

A weather projecting housing (2), or hood protrudes form the base above the opening and thee inverted flange and has at it's facing downwardly open end a screen and a filter (8), both easily removable for cleaning. The screen filter are placed in a seat (4) molded in the opening or the hood and are easily released and removed by pulling a pull tab (3) at the front and of the seat. In order to reinstall the filter and screen, both of them should be inserted towards the back end of the seat and placed at 120 degree angle on two rear tabs then the front should be raised to achieve horizontal position of the filter and screen locking the latter tight in the seat. The requirements for the filter (8) are the following: a frame of the filter and the screen (9) have to be made of a corrosion and moisture resistant material, and having low initial pressure resistant since filters have tendency to freeze up.

The best combustion to accomplish desired filtering and fresh air supplying action consists to the following:

an aluminum frame, e.g. 7.5" by 8.0", enclosing a screen made as a two sided raised pattern grill;

a filter made of 100% synthetic fiber;

0.06 w.g. initial pressure resistance at 100 cfm.

The raised pattern grill allows the frost to build up, keeping it off the filter and at the same time leaving openings for the air to flow through.

The venting and filtering device can be installed in a new system as well as in existing one after and existing rain cap is removed.

The filter may be made from a material distributed in Canada and U.S.A. under the trade name RX PolyMed.

The invention claimed is:

1. A pre-filtering device for removing contaminants from fresh air supplied to a forced air heating circulating system in a building comprising: a one piece polypropylene molded vent having a planar base installed on an outside surface of the building, the base having a circular opening and an inverted flange along the circumference of the opening, the inverted flange protruding outwardly from the base, and thereafter inwardly creating a circumferential groove opened toward the wall to accommodate a fresh air supply duct protruding form the wall of the building through an air intake opening;

The vent further comprising a weather protecting housing in a shape of a hood extended from the base over the intake opening, the open end of the hood having an integrally molded seat having a front rear end, and placed on the seat a filter having a moisture resistant material encompassed by a ⅝ aluminum frame, a ⅛ raised pattern grill with ¼ inch diamond shaped openings, a seat having a lock and a pull tab in the front end to release and remove the filter from the seat.

2. The pre-filter device as defined in claim 1 where in said base with the inverted flange is flush mounted to a metal base of an existing weather protecting housing.

3. The pre-filtering device as defined in claim 1 where in said removable filter consists of an aluminum frame, raised pattern grill, and one hundred percent moisture resistant synthetic fiber material.

* * * * *